US007122948B2

(12) United States Patent
Kanao et al.

(10) Patent No.: US 7,122,948 B2
(45) Date of Patent: Oct. 17, 2006

(54) SPARK PLUG HAVING ENHANCED CAPABILITY TO IGNITE AIR-FUEL MIXTURE

(75) Inventors: Keiji Kanao, Aichi-ken (JP); Shinichi Okabe, Aichi-ken (JP)

(73) Assignees: Denso Corporation, (JP); Nippon Soken, Inc., (JP)

( * ) Notice: Subject to any disclaimer, the term of this patent is extended or adjusted under 35 U.S.C. 154(b) by 63 days.

(21) Appl. No.: 10/942,092

(22) Filed: Sep. 16, 2004

(65) Prior Publication Data

US 2005/0057131 A1 Mar. 17, 2005

(30) Foreign Application Priority Data

Sep. 16, 2003 (JP) ..... 2003-322843
Aug. 27, 2004 (JP) ..... 2004-248822

(51) Int. Cl.
*H01T 13/20* (2006.01)

(52) U.S. Cl. ..... 313/141; 313/142; 313/143

(58) Field of Classification Search ..... 313/141–144, 313/118; 123/169 EL, 169 R
See application file for complete search history.

(56) References Cited

U.S. PATENT DOCUMENTS 5,929,556 A 7/1999 Matsubara et al.
6,147,441 A 11/2000 Osamura
6,573,641 B1 * 6/2003 Matsutani ..... 313/141
2004/0027042 A1 * 2/2004 Matsutani et al. ..... 313/141

FOREIGN PATENT DOCUMENTS

JP 9-199260 7/1997
JP 9-219274 8/1997

* cited by examiner

*Primary Examiner*—Joseph Williams
*Assistant Examiner*—Bumsuk Won
(74) *Attorney, Agent, or Firm*—Nixon & Vanderhye PC

(57) ABSTRACT

A spark plug includes a metal shell, an insulator, a center electrode, and a ground electrode. The metal shell has a threaded portion with an outer diameter of equal to or less than 10 mm, or equal to 12 mm for installing the spark plug in an internal combustion engine. The dimensional parameters in the structure of the spark plug, such as a clearance X between the center electrode and the insulator, a surface-creeping distance Y outside the metal shell, a protruding length Y1 of the insulator, an air pocket size Z, and a surface-creeping distance W inside the metal shell satisfy the dimensional relationships defined through experimental investigation in the invention. The structure ensures a high capability of the spark plug to ignite the air-fuel mixture even when the insulator thereof is fouled with carbon.

21 Claims, 10 Drawing Sheets

FIG. 3

| TYPE | G | X | Y | Y1 | Z | (X+0.3Y+Z)/G | SURF.-CREEPING SPARKS (%) |
|---|---|---|---|---|---|---|---|
| K1 | 1.1 | 0.1 | 1.5 | 1.0 | 1.25 | 1.64 | 65 |
| K2 | 0.9 | 0.1 | 1.5 | 1.0 | 1.25 | 2.00 | 20 |
| K3 | 1.1 | 0.1 | 1.5 | 1.0 | 1.55 | 1.91 | 30 |
| K4 | 0.9 | 0.1 | 1.5 | 1.0 | 1.55 | 2.33 | 15 |
| K5 | 0.7 | 0.1 | 1.1 | 0.6 | 1.15 | 2.26 | 15 |
| K6 | 0.7 | 0.1 | 1.5 | 1.0 | 1.15 | 2.43 | 0 |
| K7 | 0.7 | 0.1 | 1.1 | 0.6 | 1.35 | 2.54 | 0 |
| K8 | 0.7 | 0.1 | 1.5 | 1.0 | 1.35 | 2.71 | 0 |
| K9 | 0.7 | 0.1 | 1.1 | 0.6 | 1.55 | 2.83 | 0 |
| K10 | 0.7 | 0.1 | 1.5 | 1.0 | 1.55 | 3.00 | 0 |
| K11 | 0.7 | 0.1 | 2.9 | 2.5 | 1.55 | 3.60 | 0 |
| K12 | 0.7 | 0.1 | 2.9 | 2.5 | 1.10 | 2.96 | 0 |
| K13 | 0.7 | 0.1 | 2.9 | 2.5 | 1.20 | 3.10 | 0 |
| K14 | 0.7 | 0.1 | 2.9 | 2.5 | 1.25 | 3.17 | 0 |
| K15 | 0.7 | 0.1 | 2.9 | 2.5 | 1.30 | 3.24 | 0 |
| K16 | 0.7 | 0.1 | 2.9 | 2.5 | 1.55 | 3.60 | 0 |
| K17 | 0.7 | 0.1 | 2.9 | 2.5 | 1.65 | 3.74 | 0 |
| K18 | 0.9 | 0.2 | 2.9 | 2.5 | 1.45 | 2.80 | 10 |
| K19 | 0.8 | 0.2 | 2.9 | 2.5 | 1.45 | 3.15 | 0 |
| K20 | 0.7 | 0.2 | 2.9 | 2.5 | 1.45 | 3.60 | 0 |

| TYPE | G | X | Y | Y1 | Z | W | (X+0.3Y+Z)/G | W/Z | INSIDE SPARKS (%) |
|---|---|---|---|---|---|---|---|---|---|
| K5 | 0.7 | 0.1 | 1.1 | 0.6 | 1.15 | 3.9 | 2.26 | 3.39 | 80 |
| K6 | 0.7 | 0.1 | 1.5 | 1.0 | 1.15 | 3.9 | 2.43 | 3.39 | 25 |
| K7 | 0.7 | 0.1 | 1.1 | 0.6 | 1.35 | 5.9 | 2.54 | 4.37 | 20 |
| K8 | 0.7 | 0.1 | 1.5 | 1.0 | 1.35 | 5.9 | 2.71 | 4.37 | 0 |
| K9 | 0.7 | 0.1 | 1.1 | 0.6 | 1.55 | 7.9 | 2.83 | 5.10 | 30 |
| K10 | 0.7 | 0.1 | 1.5 | 1.0 | 1.55 | 7.9 | 3.00 | 5.10 | 0 |
| K11 | 0.7 | 0.1 | 3.1 | 2.5 | 1.55 | 7.9 | 3.69 | 5.10 | 0 |

| R | G | X | Y | Y1 | Z | (X+0.3Y+Z)/G | SURF.-CREEPING SPARKS (%) |
|---|---|---|---|---|---|---|---|
| 0 | 0.8 | 0.15 | 3.3 | 2.5 | 1.45 | 3.22 | 15 |
| 0.2 | 0.8 | 0.15 | 3.2 | 2.5 | 1.45 | 3.19 | 5 |
| 0.3 | 0.8 | 0.15 | 3.1 | 2.5 | 1.45 | 3.17 | 0 |
| 0.4 | 0.8 | 0.15 | 3.1 | 2.5 | 1.45 | 3.16 | 0 |
| 0.7 | 0.8 | 0.15 | 2.9 | 2.5 | 1.45 | 3.09 | 0 |

| TYPE | G | X | Y | Y1 | Z | (X+0.3Y+Z)/G | SURF.-CREEPING SPARKS (%) |
|---|---|---|---|---|---|---|---|
| K21 | 1.1 | 0.1 | 3.0 | 2.5 | 1.8 | 2.55 | 0 |
| K22 | 1.2 | 0.1 | 3.0 | 2.5 | 1.8 | 2.33 | 0 |
| K23 | 1.3 | 0.1 | 3.0 | 2.5 | 1.8 | 2.15 | 5 |
| K24 | 1.4 | 0.1 | 3.0 | 2.5 | 1.8 | 2.00 | 15 |

SPARK PLUG HAVING ENHANCED CAPABILITY TO IGNITE AIR-FUEL MIXTURE

BACKGROUND OF THE INVENTION

1. Technical Field of the Invention

The present invention relates generally to spark plugs for internal combustion engines. More particularly, the invention relates to an improved structure of a spark plug for an internal combustion engine of an automotive vehicle which ensures a high capability of the spark plug to ignite the air-fuel mixture (referred to as ignition capability of the spark plug hereinafter).

2. Description of the Related Art

Conventional spark plugs for use in internal combustion engines generally include a metal shell, an insulator, a center electrode, and a ground electrode.

The metal shell has a threaded portion for fitting the spark plug into a combustion chamber of the engine. The insulator has a center bore formed therein, and is fixed in the metal shell such that an end thereof protrudes from an end of the metal shell. The center electrode is secured in the center bore of the insulator such that an end thereof protrudes from the end of the insulator. The ground electrode has a side surface, and is joined to the end of the metal shell such that the side surface thereof is opposed to and spaced from the end of the center electrode so as to form a spark gap therebetween.

In recent years, the demand for higher power output of an internal combustion engine has required increasing the sizes of intake and exhaust valves for the engine and securing a water jacket for cooling of the engine. This results in a decreased space available for installing a spark plug in the engine, thus requiring the spark plug to be slenderized.

For example, the threaded portion of the metal shell of a spark plug had an outer diameter of M14 as specified in JIS (Japanese Industrial Standards) in the past; however, the threaded portion is now required to have an outer diameter of equal to or less than M12 as specified in JIS.

Moreover, the engine types of high compression or lean burn have recently been used in engine design for the purpose of increasing power output or improving fuel economy. When the combustion condition of such a type engine comes to worsen, carbon and other unburned products will deposit on the surface of the insulator around the end thereof. Such deposit causes a problem of "carbon fouling".

In a slenderized spark plug, the volume of an air pocket is accordingly reduced which is the space between an outer surface of the insulator and an inner surface of the metal shell. The reduced volume of the air pocket can cause generation of "surface-creeping sparks" which move from the center electrode of the spark plug along an outer surface of the insulator, and fly to the metal shell of the spark plug.

Such surface-creeping sparks are more frequently generated in a spark plug where the insulator thereof is fouled with carbon, since the electrically conductive carbon deposit on the surface of the insulator reduces an insulation resistance between the insulator and the metal shell.

To suppress generation of surface-creeping sparks, U.S. Pat. No. 6,147,441 (referred to as a first reference hereinafter) discloses a spark plug which has the threaded portion of a metal shell with an outer diameter in the range of 10–12 mm. The spark plug has specified ranges for dimensional parameters, such as a length of a discharge gap (i.e., a spark gap size), a width of a gas volume (i.e., an air pocket size), a protruding length of an insulator with respect to a fitting piece (i.e., a metal shell), a diameter of a center electrode, an end diameter of a noble metal tip (i.e., noble metal chip), and a protruding height of the noble metal tip with respect to the center electrode.

Moreover, to solve the above-described problem of carbon fouling, U.S. Pat. No. 5,929,556 (referred to as a second reference hereinafter) discloses another type of spark plug. The spark plug has a structure where a center electrode retracts from an end of an insulator, so that, when the insulator is fouled with carbon, the carbon deposit on the surface of the insulator can be burned off during generation of surface-creeping sparks.

The inventors of the present invention have found through investigation that, in a slenderized spark plug that has the structure disclosed in the first reference, the generation of surface-creeping sparks cannot be effectively suppressed even when the insulator thereof is not fouled with carbon.

FIG. 11 shows a spark gap 50 and its proximity in a typical spark plug. The spark plug includes, as shown in the figure, a metal shell 10, and insulator 20, a center electrode 30, and a ground electrode 40. Dimensional parameters, which are employed in the investigation of the inventors for the spark plug disclosed in first reference, are also designated in FIG. 11. Those parameters include:

a clearance X between the center electrode 30 and the insulator 20;

a surface-creeping distance Y of the insulator 20 outside the metal shell 10;

a protruding length Y1 of the insulator 20;

an air pocket size Z;

a spark gap size G; and a surface-creeping distance W of the insulator 20 inside the metal shell 10.

In addition, a surface-creeping spark distance of the spark plug is represented by a combinational parameter (X+Y+Z).

The relationship between the spark gap size G and the surface-creeping spark distance (X+Y+Z) has a great influence on generation of surface-creeping sparks. More specifically, for a given spark gap size G, a greater surface-creeping spark distance (X+Y+Z) is more advantageous to suppressing generation of surface-creeping sparks.

However, when the structure disclosed in the first reference is applied to a slenderized spark plug, especially to one which has the threaded portion of a metal shell with an outer diameter equal to or less than 10 mm, the air pocket size Z of the spark plug cannot be allowed to have a large value. As a result, the surface-creeping spark distance (X+Y+Z) of the spark plug becomes so small with respect to the spark gap size G that generation of surface-creeping sparks in the spark plug cannot be effectively suppressed.

The spark plug disclosed in the second reference is designed, as described above, to prevent decrease of the insulation resistance between the insulator and the metal shell through burning off the carbon deposit on the insulator surface during generation of surface-creeping sparks, when the insulator is fouled with carbon.

However, the problem of carbon fouling has become very serious to a recent spark plug used in an engine of high compression or lean burn type. A large amount of carbon deposit builds up on the surface of the insulator around the end of the same, so that the insulation resistance of the portion of the insulator protruding from the end of the metal shell comes to decrease, resulting in a short circuit of the spark plug.

Specifically, in FIG. 11, a large amount of carbon deposit builds up in the clearance X between the center electrode 30 and the insulator 20 and on the outer surface of the insulator 20 corresponding to the surface-creeping distance Y, resulting in the short circuit.

When the carbon deposit builds up gradually, it is possible for the spark plug disclosed in the second reference to prevent the decrease of the insulation resistance through burning off the carbon deposit. However, when a large amount of carbon deposit builds up rapidly, the carbon deposit cannot be timely cleaned through burning off.

Further, the inventors of the present invention have found through an investigation that the ignition capability of the spark plug disclosed in the second reference will drop rapidly when surface-creeping sparks are generated in the spark plug.

The investigation has found that the air pocket size Z in the spark plug has a great influence on the ignition capability of the spark plug when surface-creeping sparks are generated in the spark plug. As the air pocket size Z increases, the ignition capability of the spark plug increases.

More specifically, when the surface-creeping sparks are generated in the air pocket of the spark plug, the space for ignition in the air pocket increases as the air pocket size Z increases, thereby facilitating ignition therein. On the contrary, a decrease in the air pocket size Z results in a decrease in the space for ignition, which leads to a misfire of the engine.

The spark plug disclosed in the second reference is, in fact, designed to keep the insulation resistance; however, the ignition capability of the spark plug is not considered under the condition where the surface-creeping sparks are generated in the spark plug.

SUMMARY OF THE INVENTION

It is, therefore, an object of the present invention to provide a slenderized spark plug having an improved structure, which ensures high ignition capability of the spark plug even when the insulator thereof is fouled with carbon.

According to one aspect of the present invention, a spark plug S1 is provided which includes:

a hollow metal shell having a first end and a second end opposed to the first end, the metal shell also having a threaded portion on an outer periphery thereof and an inner chamber opening at the first end, the threaded portion having an outer diameter equal to or less than 10 mm;

an insulator having a length with a first end and a second end opposed to the first end of the insulator, the insulator also having a bore formed therein, the insulator being fixed in the inner chamber of the metal shell such that the first end of the insulator protrudes from the first end of the metal shell;

a center electrode secured in the bore of the insulator, the center electrode having an end protruding from the first end of the insulator; and a ground electrode having a side surface, the ground electrode being joined to the first end of the metal shell such that the side surface of the ground electrode is opposed to the end of the center electrode through a spark gap, wherein a distance between an inner surface of the metal shell defining the inner chamber and an outer surface of the insulator has a maximum value on a first reference plane defined to extend perpendicular to the length of the insulator through an inner edge of the first end of the metal shell, and a minimum value on a reference plane defined to extend parallel to and spaced a given distance from the first reference plane, and wherein the following dimensional relationships are defined:

$$(X+0.3Y+Z)/G \geqq 2;$$

$$Y1 \geqq 1 \text{ mm};$$

$$W/Z \geqq 4; \text{ and}$$

$$1.25 \text{ mm} \leqq Z \leqq 1.55 \text{ mm, where}$$

X is a distance between an inner surface of the insulator defining the bore and an outer surface of the center electrode on a second reference plane defined to extend parallel to the first reference plane through an inner edge of the first end of the insulator, Y is a minimum distance from the inner edge of the first end of the insulator to the first reference plane along the first end and the outer surface of the insulator, Y1 is a distance from the first end of the insulator to the first end of the metal shell in the direction of the length of the insulator, Z is a distance between the inner surface of the metal shell and the outer surface of the insulator on the first reference plane, G is a space of the spark gap between the end of the center electrode and the side surface of the ground electrode, and W is a minimum distance on the outer surface of said insulator between the first reference plane and a third reference plane on which a distance between the inner surface of the metal shell and the outer surface of the insulator has the same value as the space G of the spark gap, the third reference plane being parallel to the first reference plane.

For the slenderized spark plug S1 according to the present invention, the dimensional relationship $(X+0.3Y+Z)/G \geqq 2$ has been specified, so that generation of surface-creeping sparks in the spark plug S1 can be suppressed when the insulator thereof is not fouled with carbon, thereby facilitating stable generation of normal sparks across the spark gap.

Further, the lower limits of Y1 and W/Z have been specified as above, so that generation of inside sparks in the slenderized spark plug S1 can be suppressed while facilitating generation of side sparks in the same, when the insulator thereof is fouled with carbon.

Furthermore, the dimensional range of the air pocket size Z has been specified as above, so that the ignition capability of the slenderized spark plug S1 can be secured via the side sparks, even when the insulator thereof is fouled with carbon.

Accordingly, high ignition capability of the spark plug S1 can be secured even when the insulator thereof is fouled with carbon.

In addition, in the structure of the spark plug S1, the space G of the spark gap between the end of the center electrode and the side surface of the ground electrode is preferably in a range of 0.4 to 0.8 mm, inclusive.

Specifying the range of the space G of the spark gap as above, generation of surface-creeping sparks in the spark plug S1 can be reliably suppressed while securing the ignition capability of the spark plug, when the insulator thereof is not fouled with carbon.

According to another aspect of the present invention, a spark plug S2 is provided which includes:

a hollow metal shell having a first end and a second end opposed to the first end, the metal shell also having a threaded portion on an outer periphery thereof and an inner chamber opening at the first end, the threaded portion having an outer diameter equal to or less than 10 mm;

an insulator having a length with a first end and a second end opposed to the first end of the insulator, the insulator also having a bore formed therein, the insulator being fixed in the inner chamber of the metal shell such that the first end of the insulator protrudes from the first end of the metal shell;

a center electrode secured in the bore of the insulator, the center electrode having an end protruding from the first end of the insulator; and a ground electrode having a side surface, the ground electrode being joined to the first end of the metal shell such that the side surface of the ground electrode is opposed to the end of the center electrode through a spark gap, wherein a distance between an inner surface of the metal shell defining the inner chamber and an outer surface of the insulator has a maximum value on a first reference plane defined to extend perpendicular to the length of the insulator through an inner edge of the first end of the metal shell, and a minimum value on a reference plane defined to extend parallel to and spaced a given distance from the first reference plane, and wherein the following dimensional relationships are defined:

$$(X+0.3Y+Z)/G \geqq 2.0;$$

$$0.4\ \text{mm} \leqq G \leqq 1.3\ \text{mm};$$

$$Y1 \geqq 1.0\ \text{mm};$$

$$W/Z \geqq 4.0;\ \text{and}$$

$$1.25\ \text{mm} \leqq Z \leqq 1.9\ \text{mm, where}$$

X is a distance between an inner surface of the insulator defining the bore and an outer surface of the center electrode on a second reference plane defined to extend parallel to the first reference plane through an inner edge of the first end of the insulator, Y is a minimum distance from the inner edge of the first end of the insulator to the first reference plane along the first end and the outer surface of the insulator, Y1 is a distance from the first end of the insulator to the first end of the metal shell in the direction of the length of the insulator, Z is a distance between the inner surface of the metal shell and the outer surface of the insulator on the first reference plane, G is a space of the spark gap between the end of the center electrode and the side surface of the ground electrode, and W is a minimum distance on the outer surface of said insulator between the first reference plane and a third reference plane on which a distance between the inner surface of the metal shell and the outer surface of the insulator has the same value as the space G of the spark gap, the third reference plane being parallel to the first reference plane.

Specifying the above dimensional relationships, high ignition capability of the slenderized spark plug S2 can be secured, even when the insulator thereof is fouled with carbon.

In the structures of the spark plugs S1 and S2, it is preferable to further define a dimensional relationship of $(X+0.3Y+Z)/G \geqq 2.5$. As a result of this, generation of surface-creeping sparks in those spark plugs can be suppressed when the insulators thereof are not fouled with carbon, thereby facilitating stable generation of normal sparks across the spark gaps of those spark plugs.

Further, in the structures of the spark plugs S1 and S2, it is preferable that inner diameters D of the metal shells at the inner edges of the first ends of the metal shells, and outer diameters M of the threaded portions of the metal shells are subject to:

$$(M-D) \geqq 3.0\ \text{mm}.$$

Specifying the above dimensional relationship between the inner and outer diameters M and D of the metal shells, the end surface areas of the metal shells can be secured, thereby enhancing heat transfers from the ground electrodes to the metal shells. As a result, the heat resistances of the ground electrodes can also be secured.

Furthermore, it is preferable that, in the structures of the spark plugs S1 and S2, the center electrodes comprise a first noble metal chip, an end of which represents the end of the center electrode. The first noble metal chip has a cross-sectional area at the end thereof in a range of 0.07 to 0.40 $mm^2$.

Specifying the dimensional range of cross-sectional area of the first noble metal chip as above, the spaces available for ignition in the spark gaps of those spark plugs are secured, while the first noble metal chip is not too thin to be worn down easily.

The first noble metal chip is preferably made of an Ir-based alloy including Ir in an amount of greater than 50 weight percent and at least one additive; the Ir-based alloy has a melting point of greater than 2000 degrees Celsius. Furthermore, the at least one additive is preferably selected from Pt, Rh, Ni, W, Pd, Ru, Re, Al, $Al_2O_3$, Y, $Y_2O_3$.

Specifying the material of the first noble chip, a long service life can be secured for the center electrodes of those spark plugs S1 and S2.

Moreover, in the structures of the spark plugs S1 and S2, it is preferable that the ground electrodes include a second noble metal chip having a first end joined to the side surface of the ground electrode and a second end opposed to the end of the center electrode through the spark gap. The second noble metal chip has a cross-sectional area at the second end thereof in a range of 0.12 to 0.80 $mm^2$, and a distance between the second end of the second noble metal chip and the side surface of the ground electrode is in a range of 0.3 to 1.5 mm.

Through specifying the above dimensional ranges of the second noble metal chip, the spaces available for ignition in the spark gaps of those spark plugs are secured, while the second noble metal chip is not too thin to be worn down easily.

The second noble metal chip is preferably made of a Pt-based alloy including Pt in an amount of greater than 50 weight percent and at least one additive; the Pt-based alloy has a melting point of greater than 1500 degrees Celsius. Furthermore, the at least one additive is selected from Ir, Rh, Ni, W, Pd, Ru, Re.

Through specifying the material of the second noble chip, a long service life can be secured for the ground electrodes of those spark plugs S1 and S2.

Additionally, it is preferable that, in the structures of the spark plugs S1 and S2, an outer edge of the first end of the insulator is rounded with a radius equal to or greater than 0.2 mm.

Through specifying the outer edges of the first ends of the insulators as above, generation of surface-creeping sparks in those spark plugs S1 and S2 can be more effectively suppressed.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings:

FIG. 3 is a table showing detailed parameters and their values for tested sample spark plugs of different types in connection with the first embodiment of the invention;

DESCRIPTION OF THE PREFERRED EMBODIMENTS

Figure 1:
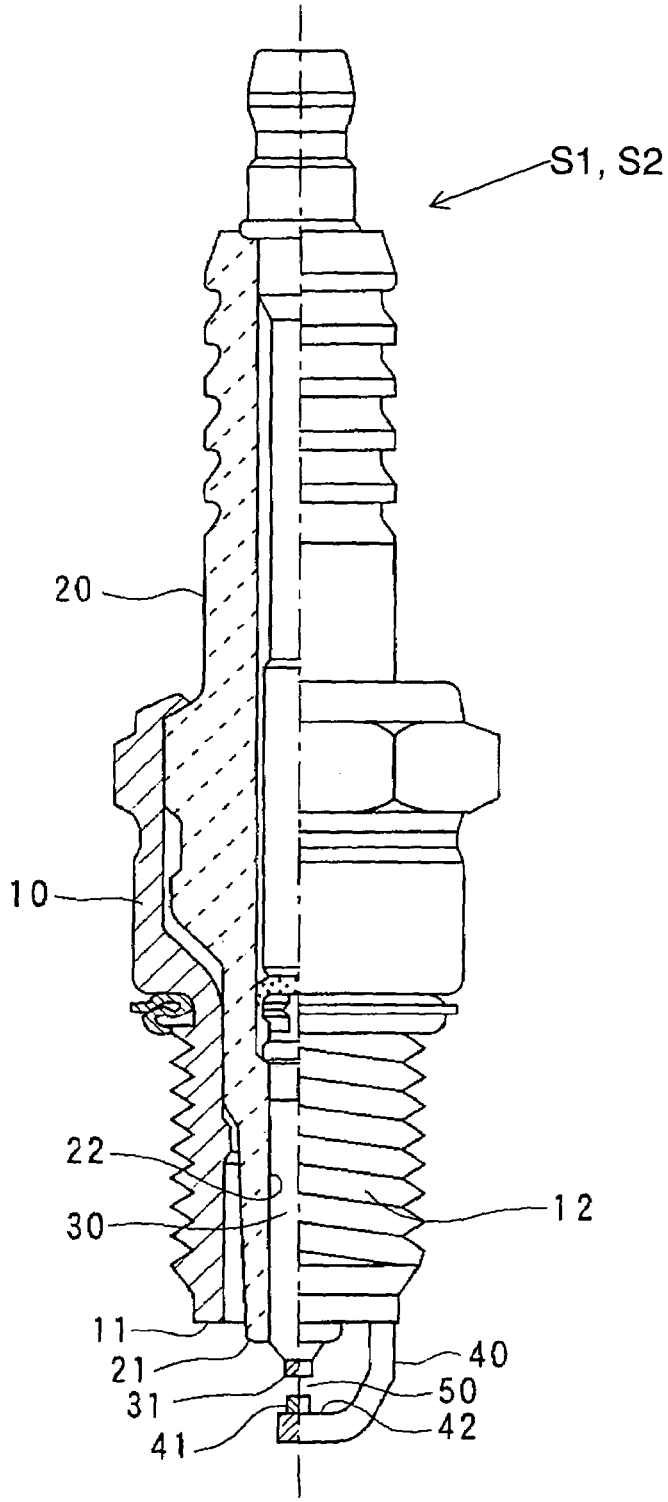
FIG. 1 is a partially cross-sectional side view showing an overall structure of a spark plug according to the first embodiment of the invention.

The preferred embodiments of the present invention will be described hereinafter with reference to FIGS. 1–12.

It should be noted that, for the sake of clarity and understanding, identical components having identical functions in the different embodiments of the invention have been marked, where possible, with the same reference numerals in each of the figures.

[First Embodiment]

FIG. 1 shows an overall structure of a spark plug S1 according to the first embodiment of the invention.

The spark plug S1 is designed for use in internal combustion engines of automotive vehicles. The installation of the spark plug S1 in an internal combustion engine is achieved by fitting it into a combustion chamber (not shown) of the engine through a threaded bore provided in the engine head (not shown).

As shown in FIG. 1, the spark plug S1 includes a metal shell 10, an insulator 20, a center electrode 30, and a ground electrode 40.

The cylindrical metal shell 10 is made of a conductive metal material, for example a low-carbon steel. The metal shell 10 has a threaded portion 12 on the outer periphery thereof for fitting the spark plug S1 into the combustion chamber of the engine as described above.

The threaded portion 12 of the metal shell 10 has an outer diameter equal to or less than 10 mm. This range corresponds to the range of M10 as specified in JIS (Japanese Industrial Standards).

The tubular insulator 20, which is made of alumina ceramic ($Al_2O_3$), is fixed and partially contained in the metal shell 10 such that an end 21 of the insulator 20 protrudes from an end 11 of the metal shell 10.

The cylindrical center electrode 30 is made of a highly heat conductive metal material such as Cu as the core material and a highly heat-resistant, corrosion-resistant metal material such as a Ni (Nickel)-based alloy as the clad material.

The center electrode 30 is secured in a center bore 22 of the insulator 20, so that it is isolated from the metal shell 10. The center electrode 30 is partially included in the metal shell 10 together with the insulator 20 such that an end 31*a* of the center electrode 30 protrudes form the end 21 of the insulator 20.

The ground electrode 40, which is made of a Ni-based alloy consisting mainly of Ni, is column-shaped, for example an approximately L-shaped prism in this embodiment.

The ground electrode 40 has one end portion joined, for example by welding, to the end 11 of the metal shell 10. The other end portion of the ground electrode 40 has a side surface 42 that is opposed to the end 31*a* of the center electrode 30.

Figure 2:
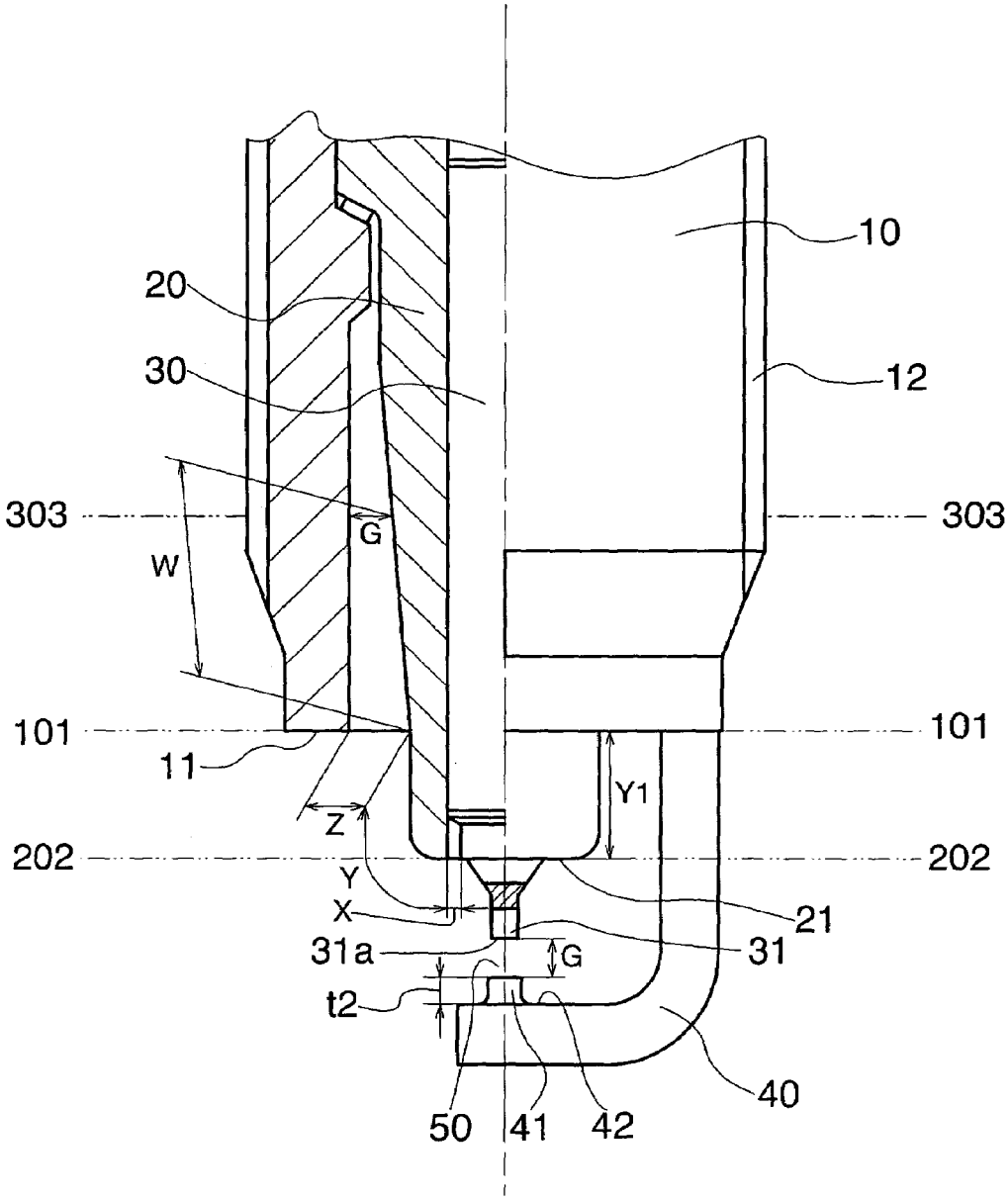
FIG. 2 is an enlarged partially cross-sectional side view showing a spark gap and the proximity thereof in the spark plug of FIG. 1.

Referring now to FIG. 2, the center electrode 30 includes a first cylindrical noble metal chip 31, an end of which represents the end 31*a* of the center electrode 30. The first noble metal chip 31 has a cross-sectional area S1 at the end 31*a*, preferably, in the range of 0.07 to 0.4 $mm^2$.

In this embodiment, the first noble metal chip 31 is joined to the base material of the center electrode 30 by laser welding.

The first noble metal chip 31 is preferably made of an Ir (Iridium)-based alloy including Ir in an amount of greater than 50 weight percent and at least one additive; the melting point of the alloy is greater than 2000 degrees Celsius.

Furthermore, the at least one additive is preferably selected from Pt (Platinum), Rh (Rhodium), Ni, W (Tungsten), Pd (Palladium), Ru (Ruthenium), Re (Rhenium), Al (Aluminum), $Al_2O_3$ (Alumina), Y (Yttrium), $Y_2O_3$ (Yttria).

The ground electrode 40 includes a second cylindrical noble metal chip 41, which has a first end joined to the side surface 42 of the ground electrode 40 and a second end opposed to the end 31*a* of the first noble metal chip 31 through the spark gap 50.

The second noble metal chip 41 of the ground electrode 40 has a cross-sectional area S2 at the second end thereof, preferably, in the range of 0.12 to 0.80 $mm^2$. A distance t2 between the second end of the second noble metal chip 41 and the side surface 42 of the ground electrode 40 is, preferably, in the range of 0.3 to 1.5 mm.

In this embodiment, the second noble metal chip 41 is joined to the side surface 42 of the ground electrode 40 by laser welding.

The second noble metal chip 41 is preferably made of a Pt-based alloy including Pt in an amount of greater than 50 weight percent and at least one additive; the melting point of the Pt-based alloy is greater than 1500 degrees Celsius.

Furthermore, the at least one additive for the second noble metal chip 41 is preferably selected from Ir, Rh, Ni, W, Pd, Ru, Re.

Additionally, other joining means may also be used to join the first and second noble metal chips 31 and 41 to the center and ground electrodes 30 and 40 respectively, such as resistance welding, plasma welding, and adhesive joining. Moreover, the two noble metal chips 31 and 41, which have cylindrical shapes in this embodiment, may also have prismatic shapes.

The end 31*a* of the first noble metal chip 31 and the second end of the second noble metal chip 31 are spaced from each other so as to form the spark gap 50 therebetween. The spark gap 50 has a space G, the range of which will be described below.

It should be noted that a sharp outer edge of the end 21 of the insulator 20 tends to induce a strong electric field around it, thereby facilitating generation of surface-creeping sparks in the spark plug. Therefore, the outer edge of the end 21 of the insulator 20 is rounded with a radius R.

Moreover, as seen from FIG. 2, an air pocket is formed between a lower portion of an inner surface of the metal shell 10 and a lower portion of an outer surface of the insulator 20. In the air pocket, a distance between the inner surface of the metal shell 10 and the outer surface of the insulator 20 has a maximum value on a reference plane 101, and decreases toward the inside of the air pocket away from the reference plane 101. The reference plane 101 is defined to extend perpendicular to the longitudinal direction of the insulator 20 through an inner edge of the end 11 of the metal shell 10.

Having described all the essential components of the spark plug S1, the dimensional parameters designated as G, W, X, Y, Y1, Z in FIG. 2 will be defined and described hereinafter. Those parameters are critical to the structure of the spark plug S1.

X is a distance between an inner surface of the insulator 20 defining the center bore 22 and an outer surface of the center electrode 30 on a reference plane 202 defined to extend parallel to the reference plane 101 through an inner edge of the end 21 of the insulator 20 (referred to as a clearance X between the center electrode 30 and the insulator 20 hereinafter).

Y is a minimum distance from the inner edge of the end 21 of the insulator 20 to the reference plane 101 along the end 21 and the outer surface of the insulator 20 (referred to as a surface-creeping distance Y of the insulator 20 outside the metal shell 10).

Y1 is a distance from the end 21 of the insulator 20 to the end 11 of the metal shell 10 in the longitudinal direction of the insulator 20 (referred to as protruding length Y1 of the insulator 20 hereinafter).

Z is a distance between the inner surface of the metal shell 10 and the outer surface of the insulator 20 on the reference plane 101 (referred to as an air pocket size Z hereinafter).

G is a space of the spark gap 50 between the end 31*a* of the first noble metal chip 31 and the second end of the second noble metal chip 41 (referred to as a spark gap size G hereinafter).

W is a minimum distance on the outer surface of the insulator 20 between the reference plane 101 and a reference plane 303 parallel to the reference plane 101. On the reference plane 303, the distance between the inner surface of the metal shell 10 and the outer surface of the insulator 20 has the same value as the space G of the spark gap 50 (referred to as a surface-creeping distance W of the insulator 20 inside the metal shell 10).

Additionally, a combinational parameter represented by (X+0.3Y+Z) has been employed to investigate how to effectively suppress generation of surface-creeping sparks in the spark plug S1.

The above-defined parameters have been employed in light of the following consideration of the inventors.

To ensure high ignition capability of the spark plug S1 when the insulator 20 thereof is not fouled with carbon, it is necessary to suppress generation of surface-creeping sparks in the spark plug, so that normal sparks can be reliably generated across the spark gap 50.

As described previously, with respect to a given spark gap size G, a greater surface-creeping spark distance (X+Y+Z) is more advantageous to suppressing generation of surface-creeping sparks. Moreover, it has been known from experience that, with respect to the same sparking distance, a required spark voltage for generating the surface-creeping sparks is 0.3 times that for generating normal sparks across the spark gap 50.

Therefore, the inventors of the present invention have employed the parameter (X+0.3Y+Z) to experimentally investigate how to effectively suppress generation of surface-creeping sparks in the spark plug S1. Specifically, the inventors have investigated the effect of the ratio (X+0.3Y+Z)/G, which represents the ratio of the surface-creeping spark distance to the spark gap size G, on suppressing generation of surface-creeping sparks, Further, to ensure high ignition capability of the spark plug S1 when the insulator 20 thereof is fouled with carbon, it is necessary to first recognize that there are two different patterns of surface-creeping sparks. One pattern is "side sparks" which fly to a portion of the inner surface of the metal shell 10 adjoining the end 11 of the metal shell 10; the other pattern is "inside sparks" which fly to another portion of the inner surface of the metal shell 10 defining the inside of the air pocket in the spark plug. The two patterns of surface-creeping sparks are illustrated in FIGS. 12A and 10B respectively.

Figure 12B:
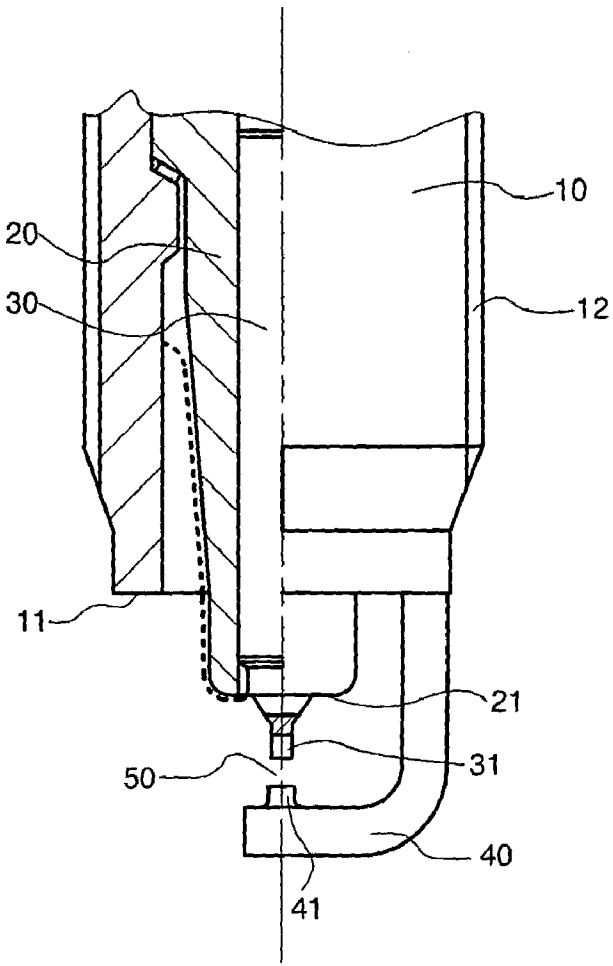
FIG. 12B is a view illustrating the trajectory of an inside spark in a spark plug.
Figure 12A:
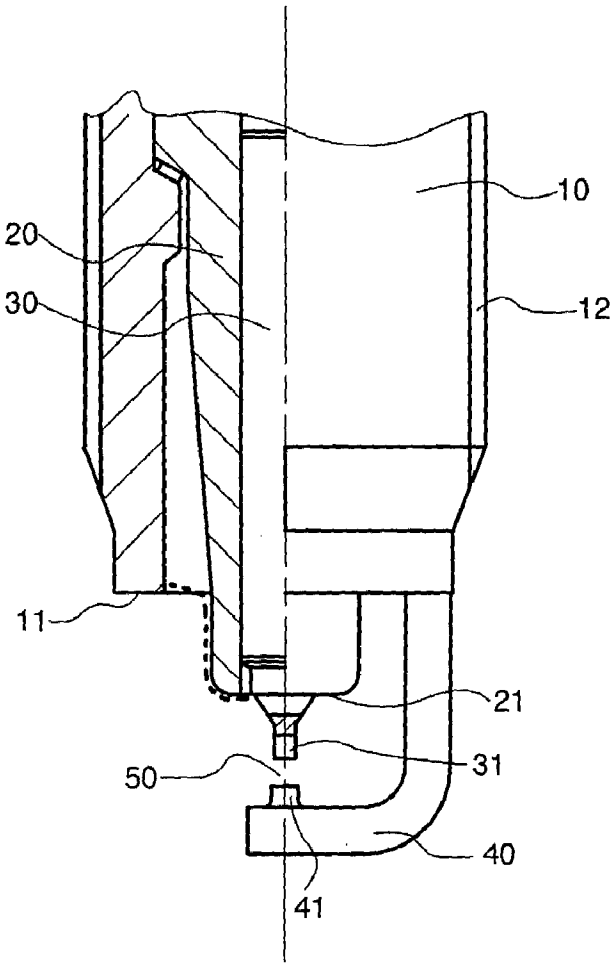
FIG. 12A is a view illustrating the trajectory of a side spark in a spark plug.

In FIG. 12A, the side sparks, a trajectory of which is shown with a dashed line, move from the center electrode 30 along the outer surface of the insulator 20, and fly across the air pocket to the portion of the inner surface of the metal shell 10 adjoining the end 11 of the same.

In FIG. 12B, the inside sparks, a trajectory of which is also shown with a dashed line, move from the center electrode 30 along the outer surface of the insulator 20, and fly across the air pocket to the portion of the inner surface of the metal shell 10 defining the inside of the air pocket with the outer surface of the center electrode 30.

It is clear from the FIG. 12B that in the case of inside sparks, the space for ignition in the inside of the air pocket is so small that ignition therein cannot be successful. Therefore, when the insulator 20 of the spark plug S1 is fouled with carbon, it is necessary to prevent generation of inside sparks so as to ensure the ignition capability of the spark plug S1.

In other words, when the insulator 20 of the spark plug S1 is fouled, it is required to render the generated surface-creeping sparks being side sparks, thereby igniting the air-fuel mixture in the combustion chamber, not in the inside of the spark plug S1.

Further, when the protruding length Y1 of the insulator 20 is large, it is difficult for the surface-creeping sparks to arrive in the inside of the air pocket, so that the surface-creeping sparks will become side sparks rather than inside sparks.

Specifically, in FIG. 2, the inside of the air pocket of the spark plug S1 is defined as the portion of the air pocket above the reference plane 303, where the inside sparks are most tend to be generated. As described above, the distance between the inner surface of the metal shell 10 and the outer surface of the insulator 20 on the reference plane 303 has the same value as the spark gap size G.

A small surface-creeping distance W indicates that the inside of the air pocket is spaced near to the end 11 of the metal shell 10, thereby by facilitating generation of the inside sparks.

In other words, a large surface-creeping distance W is more advantageous to preventing generation of inside sparks. Therefore, a ratio W/Z has been employed in the investigation, considering the dimensional balance between the surface-creeping distance W and the air pocket gap size Z.

The inventors of the present invention have accordingly investigated the effect of the two parameters Y1 and W/Z on suppressing generation of inside sparks in the slenderized spark plug S1 when the insulator 20 thereof is fouled with carbon.

Moreover, as described above, it is required for the air pocket gap size Z of the slenderized spark plug S1 to have a large value, so that the ignition capability of the spark plug S1 can be secured through side sparks. However, at the same time, an exceedingly large air pocket size Z results in the inside sparks rather than the side sparks. Therefore, the inventors of the present invention have investigated the relationship between the air pocket gap size Z and the capability of the slenderized spark plug S1 to ignite the air-fuel mixture through the side sparks.

The dimensional relationships between the above-described parameters, which characterize the structure of the spark plug S1 according to the present embodiment, have been determined based on the investigation results from the inventors.

Sample spark plugs of 20 different types k1–k20 were fabricated for the investigation. All the sample spark plugs included a metal shell 10 having a threaded portion 12 with an outer diameter equal to 10 mm. In other words, all the sample spark plugs were slenderized one. The detailed values of the above-described parameters for each sample spark plug type are shown in the table of FIG. 3. The occurrence rates of surface-creeping sparks for each type are also shown in the same table, which are obtained through the investigation.

It should be noted that the investigation results to be shown below are particularly for the spark plug S1 where the outer diameter of the threaded portion 12 of the metal shell 10 is 10 mm; it has been, however, experimentally confirmed that the same tendency and similar results can be observed with the spark plugs S1 where the outer diameter is less than 10 mm.

First, the relationship between the parameter (X+0.3Y+Z)/G and the occurrence rate of surface-creeping sparks have been experimentally determined, in order to suppress generation of surface-creeping sparks in the spark plug S1 when the insulator 20 thereof is not fouled.

In the determination, sample spark plugs of K1–K20 were tested under a condition where the pressure in a pressurized chamber into which those plugs were fitted was 0.8 MPa, and the sparking interval was 30 HZ. This test condition was employed to simulate an actual acceleration condition of an engine where the required spark voltage is high, and surface-creeping sparks tend to occur. All the sample spark plugs tested in the determination had an insulator 20 that is not fouled with carbon.

Figure 4:
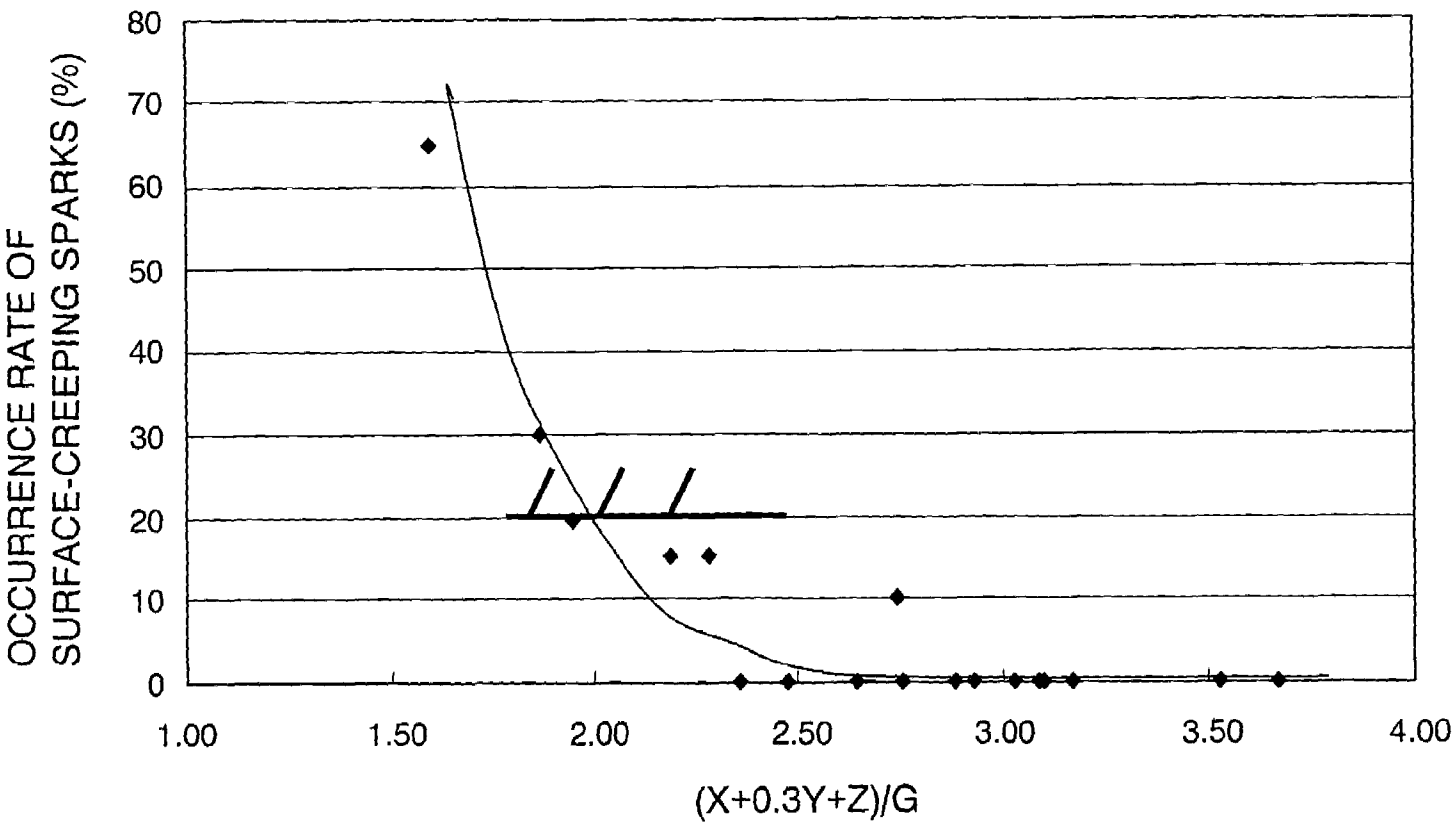
FIG. 4 is a graphical representation showing the relationship between a combinational parameter (X+0.3Y+Z)/G and the occurrence rate of "surface-creeping sparks" in a spark plug in connection with the first embodiment of the invention.

FIG. 4 shows the determination results. A target occurrence rate of 20% is also designated in the figure, which is the occurrence rate of surface-creeping sparks in a typical spark plug having the threaded portion of a metal shell with an outer diameter of 14 mm.

It can be seen from FIG. 4 that, when the parameter (X+0.3Y+Z)/G is greater than 2.0, the occurrence rate of surface-creeping sparks is suppressed below the target occurrence rate of 20%.

More specifically, satisfying the dimensional relationship of $(X+0.3Y+Z)/G \geqq 2.0$, generation of surface-creeping sparks can be suppressed in the slenderized spark plug S1, when the insulator 20 thereof is not fouled with carbon. As a result, generation of normal sparks across the spark gap 50 in the spark plug S1 can be enhanced.

Moreover, as seen from FIG. 4, it is preferred that $(X+0.3Y+Z)/G \geqq 2.5$, so as to further reliably suppress generation of surface-creeping sparks.

Secondly, the relationship between the two parameters Y1 and W/Z and the occurrence rate of inside sparks have been experimentally determined, in order to suppress generation of inside sparks while facilitating generation of side sparks in the spark plug S1 when the insulator 20 thereof is fouled with carbon.

Figures 5A, 5B:
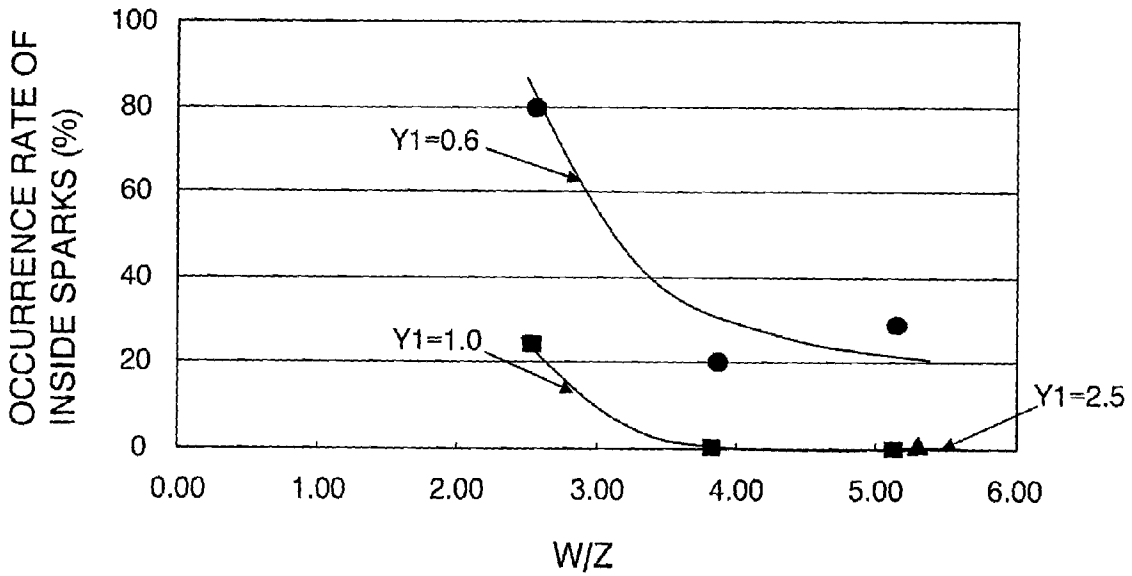
FIG. 5A is a table showing detailed parameters and their values for sample spark plugs of different types tested in an investigation in connection with the first embodiment of the invention.
FIG. 5B is a graphical representation showing the test results of the investigation using those sample spark plugs shown in FIG. 5A.

In the determination, sample spark plugs of types k5–K11 were tested. Those sample spark plugs were previously fouled by intendedly depositing carbon in the clearance between the center electrode 30 and the insulator 20 and on the outer surface of the insulator 20 corresponding to the surface-creeping distance Y of the same. The values of dimensional parameters for each type are shown in the table of FIG. 5A. The occurrence rates of inside sparks for each type are also shown in the same table, which are obtained through the determination.

FIG. 5B shows the determination results graphically. The parameter W/Z is varied, in the figure, to determine the resultant occurrence rate of inside sparks with respect to the three different protruding lengths Y1 0.6 mm, 1.0 mm, and 2.5 mm. The results for different protruding lengths Y1 are distinguished with circle plots for 0.6 mm, quadrate plots for 1.0 mm, and triangle plots for 2.5 mm.

It can be seen from FIG. 5B that, when the protruding length Y1 of the insulator 20 is equal to or greater than 1.0 mm and the parameter W/Z is equal to or greater than 4.0, the occurrence rate of inside sparks is 0%, that is, inside sparks are completely suppressed.

More specifically, satisfying the dimensional relationships $Y1 \geqq 1.0$ mm and $W/Z \geqq 4.0$, generation of inside sparks can be suppressed in the slenderized spark plug S1 while facilitating generation of side sparks, when the insulator 20 thereof is fouled with carbon.

Finally, the relationship between the air pocket size Z and the capability of the spark plug S1 to ignite the air-fuel mixture through side sparks have been experimentally determined.

Figure 6:
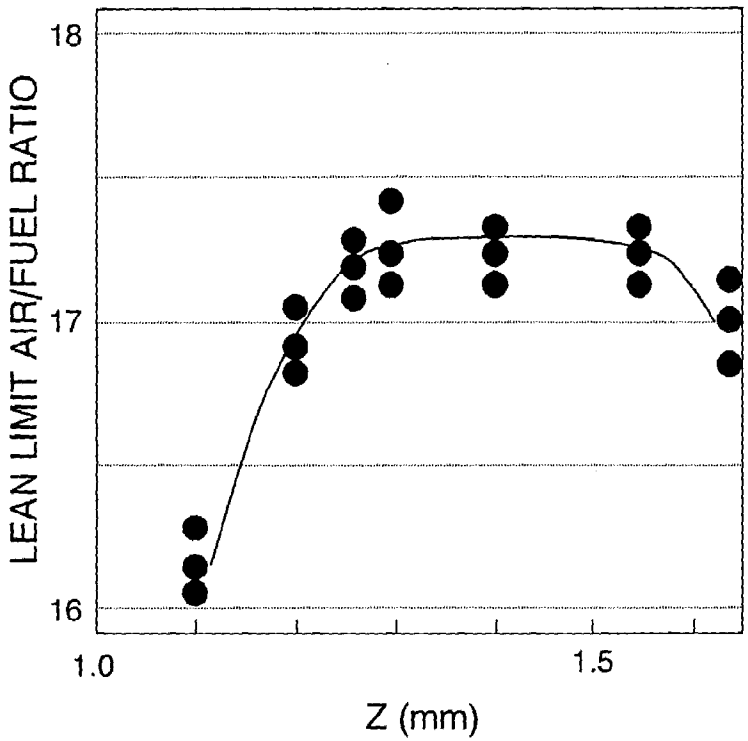
FIG. 6 is a graphical representation showing the relationship between an air pocket size Z and the lean limit air/fuel ratio in a spark plug in connection with the first embodiment of the invention.

FIG. 6 shows the determination results. The ignition capability of the spark plug is, in the figure, represented by the lean limit air/fuel ratio which is obtained when the air-fuel mixture is ignited through side sparks. A greater lean limit air/fuel ratio indicates a high ignition capability of the spark plug.

It can be seen from FIG. 6 that, when the air pocket size Z is in the range of 1.25 to 1.55 mm, the lean limit air/fuel ratio keeps a high level. When the air pocket size Z is less than 1.25 mm, the lean limit air/fuel ratio drops rapidly; the drop results from the fact that, when the air pocket size Z decreases, the space for ignition becomes so small that the flame cannot be propagated. On the contrary, when the air pocket size Z is greater than 1.55 mm, the lean limit air/fuel ratio also begins to drop; the drop results from the fact that, an exceedingly large air pocket size Z induces inside sparks rather than side sparks.

More specifically, satisfying the dimensional relationship 1.25 mm≦Z≦ 1.55 mm, the ignition capability of the slenderized spark plug S1 can be secured through the side sparks generated therein, when the insulator 20 thereof is fouled with carbon.

To sum up, the spark plug S1 according to the present embodiment, which includes the metal shell 10 having the threaded portion 12 with an outer diameter equal to or less than 10 mm, has a structure characterized in that the dimensional parameters including the clearance X, the surface-creeping distance Y, protruding length Y1 of the insulator 20, the air pocket size Z, and another surface-creeping distance W satisfy the following dimensional relationships:

$$(X+0.3Y+Z)/G \geqq 2.0;$$

$$Y1 \geqq 1.0 \text{ mm};$$

$$W/Z \geqq 4.0; \text{ and}$$

$$1.25 \text{ mm} \leqq Z \leqq 1.55 \text{ mm}.$$

The above structure ensures a high ignition capability of the slenderized spark plug S1 even when the insulator 20 thereof is fouled with carbon.

In addition, to further enhance the ignition capability of the spark plug S1, the suitable range of the spark gap size G has been experimentally determined as follows.

Referring again to FIG. 3, the three sample spark plug types K18, k19, and K20 have different values of the spark gap size G, while having the same values with respect to all the other parameters. Therefore, one can consider that the difference of the occurrence rate of surface-creeping sparks between those spark plug types have resulted from the difference of the spark gap size G therebetween.

It can be seen from FIG. 3 that, when the spark gap size G is equal to or less than 0.8 mm, the occurrence rate of surface-creeping sparks is 0%. More specifically, generation of surface-creeping sparks in the spark plug S1 can be completely suppressed when the insulator 20 thereof is not fouled with carbon.

Further, sample spark plugs of type 20, which have the reduced spark gap sizes G of 0.6 mm, 0.5 mm, 0.4 mm, and 0.3 respectively, were fabricated to determine the lower limit of the spark gap size G. Those sample spark plugs were tested together with spark plugs of K18, K19, and K20.

Figure 7:
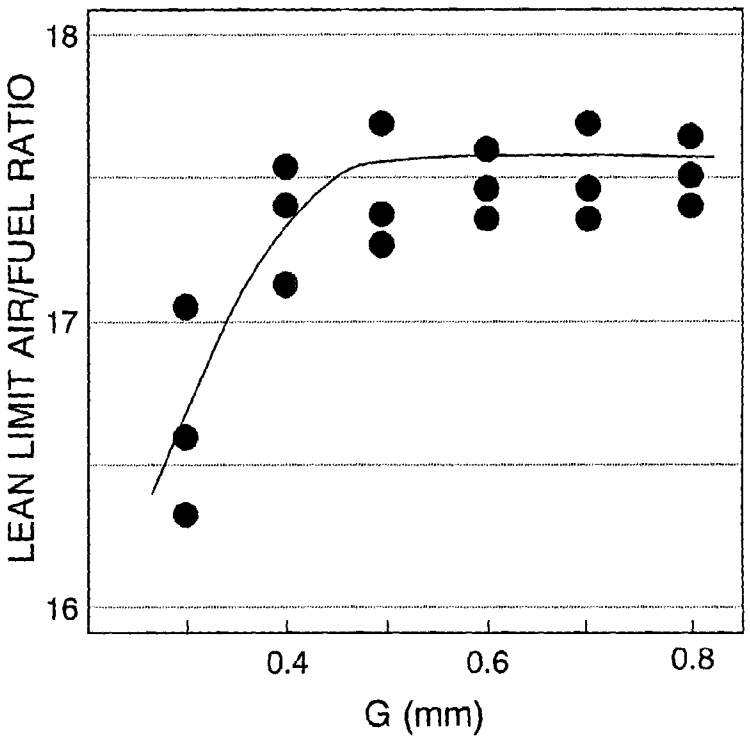
FIG. 7 is a graphical representation showing the relationship between a spark gap size G and the lean limit air/fuel ratio in a spark plug in connection with the first embodiment of the invention.

FIG. 7 shows the test results on the relationship between spark gap size G and the lean limit air/fuel ratio. As described above, a greater lean limit air-fuel ratio indicates a high ignition capability of the spark plug.

It can be seen from FIG. 7 that, when the spark gap size G is equal to or greater than 0.4 mm, the lean limit air-fuel ratio keeps a high level. More specifically, a high ignition capability of the spark plug S1 can be secured in the condition that the insulator 20 thereof is not fouled with carbon.

Accordingly, when the spark gap size G of the spark plug S1 is in the range of 0.4 to 0.8 mm, a high ignition capability of the spark plug S1 can be secured while suppressing generation of surface-creeping sparks in the condition that the insulator 20 thereof is not fouled with carbon.

It has been described that a sharp outer edge of the end 21 of the insulator 20 tends to induce a strong electric field around it, thereby facilitating generation of surface-creeping sparks in the spark plug S1.

Therefore, in the present embodiment, the outer edge of the end 21 of the insulator 20 is rounded with a radius R, the range of which is determined through an experimental investigation.

Sample spark plugs of type K19 having various radiuses R were tested in the investigation. The detailed values of parameters for those sample spark plugs are shown in FIG. 8A.

Figures 8A, 8B:
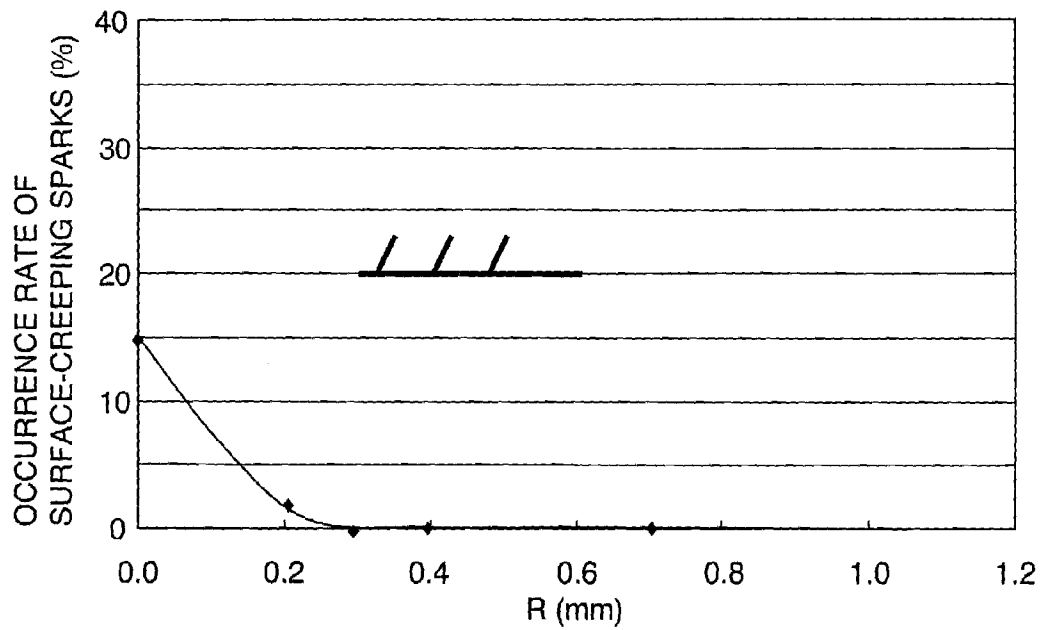
FIG. 8A is a table showing detailed parameters and their values for sample spark plugs of different types tested in an investigation in connection with the first embodiment of the invention.
FIG. 8B is a graphical representation showing the relationship between a radius R and the occurrence rate of "surface-creeping sparks" obtained in the investigation using those sample spark plugs shown in FIG. 8A.

FIG. 8B shows the investigation results. In the investigation, those surface-creeping sparks are observed which move from the center electrode 30 along the end 21 of the insulator 20, and directly fly to the ground electrode 40 in the lateral direction of the insulator 20.

As can be seen from the FIG. 8B, when the radius R is equal to or greater than 0.2 mm, the generation of surface-creeping sparks are effectively suppressed. More specifically, when the outer edge of the end 21 of the insulator 21 is rounded with a radius R equal to or greater than 0.2 mm, generation of surface-creeping sparks in the spark plug S1 can be further effectively suppressed.

It should be noted that, all the sample spark plugs of types K1–K20 shown in FIG. 3 had the radius R of equal to 0.4 mm.

Further, it is required for the metal shell 10 of the spark plug S1 to have a suitably large cross-sectional area at the end 11 thereof in order to secure the heat resistance of the ground electrode 40.

It is preferable that, in the structure of the spark plugs S1, an inner diameter D of the metal shell 10 at the inner edge of the end 11, and an outer diameter M of the threaded portion 12 of the metal shell 10 satisfy the following dimensional relationship:

$$(M-D) \geqq 3.0 \text{ mm}.$$

Specifying the above dimensional relationship, the surface area of the end 11 of the metal shell 10 can be secured, thereby enhancing the heat transfer from the ground electrode 40 to the metal shell 10. As a result, the heat resistances of the ground electrode 40 can also be secured.

Moreover, the spark gap 50 of the spark plug S1 has a small spark gap size G in the range of 0.4 to 0.8 mm as specified above. Therefore, it is preferable for the first noble metal chip 31 to be thin to secure a sufficient space for ignition. However, at the same time, when the first noble metal chip 31 is too thin, it will be worn down easily.

Accordingly, the preferable range of the cross-sectional area S1 of the first noble metal chip 31 at the end 31*a* has been specified such that S1 is in the range of 0.07 to 0.4 $mm^2$.

In addition, the preferable material of the first noble metal chip 31 has been specified, as described above, so that a long service life can be secured for the center electrode 31 of the spark plug S1.

Furthermore, the preferable ranges of the cross-sectional area S2 and the protruding length t2 of the second noble metal chip 41 has been specified such that S2 is in the range of 0.12 to 0.80 $mm^2$, and t2 is in the rage of 0.3 to 1.5 mm. As a result, the space available for ignition in the spark plug S1 is secured, while the send noble metal chip 41 is not too thin to be worn down easily.

Additionally, the preferable material of the second noble metal chip 41 has been specified, as described above, so that a long service life can also be secured for the ground electrode 41 of the spark plug S1.

[Second Embodiment]

The spark plug S1 according to the previous embodiment includes the metal shell 10 having the threaded portion 12 the outer diameter of which is equal to or less than 10 mm; in this embodiment, a spark plug S2, which includes a metal shell 10 having a threaded portion 12 with an outer diameter equal to 12 mm, is provided.

It should be noted that, for the threaded portion 12 of the spark plug S2, the outer diameter of 12 mm corresponds to M12 as specified in JIS.

The spark plug S2 has a structure almost identical to the structure of the spark plug S1, and can also be described with reference to FIGS. 1 and 2. Accordingly, the differences between the structure of the spark plug S1 and that of the spark plug S2 are mainly described in the present embodiment.

Since the spark plug S2 has the outer diameter of the threaded portion 12 of the metal shell 10 different from that of the spark plug S1, dimensional parameters in the structure of the spark plug S2 may not satisfy the same dimensional relationships as in the structure of the spark plug S1.

Therefore, the dimensional relationships of parameters, which characterize the structure of the spark plug S2 according to the present embodiment, have been determined based on investigation results from inventors.

First, with respect to the dimensional relationship $(X+0.3Y+Z)/Z \geqq 2.0$, the same tendency and similar results has been obtained as in the case of the spark plug S1. Therefore, the relationship has been specified also for the spark plug S2.

Figures 9, 10:
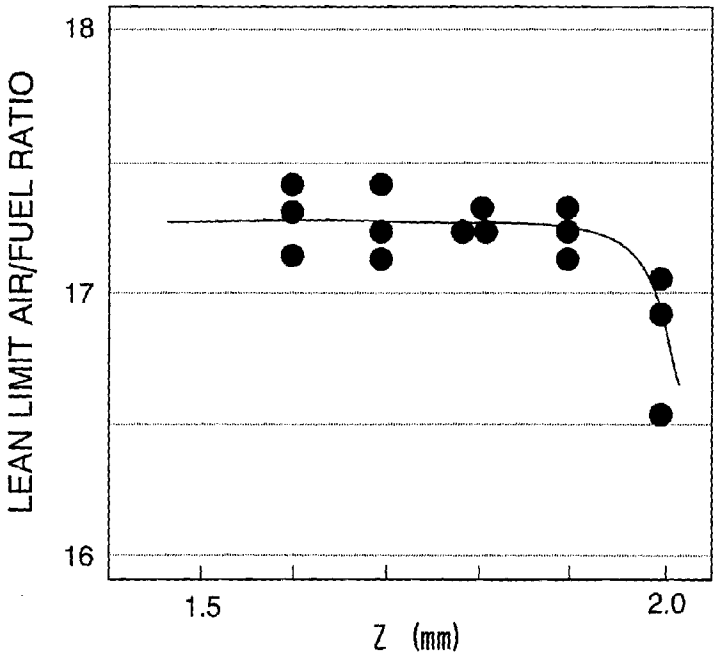
FIG. 9 is a table showing detailed parameters and their values for sample spark plugs of different types tested in an investigation in connection with the second embodiment of the invention.
FIG. 10 is a graphical representation showing the relationship between an air pocket size Z and the lean limit air/fuel ratio in a spark plug in connection with the second embodiment of the invention.
Figure 11:
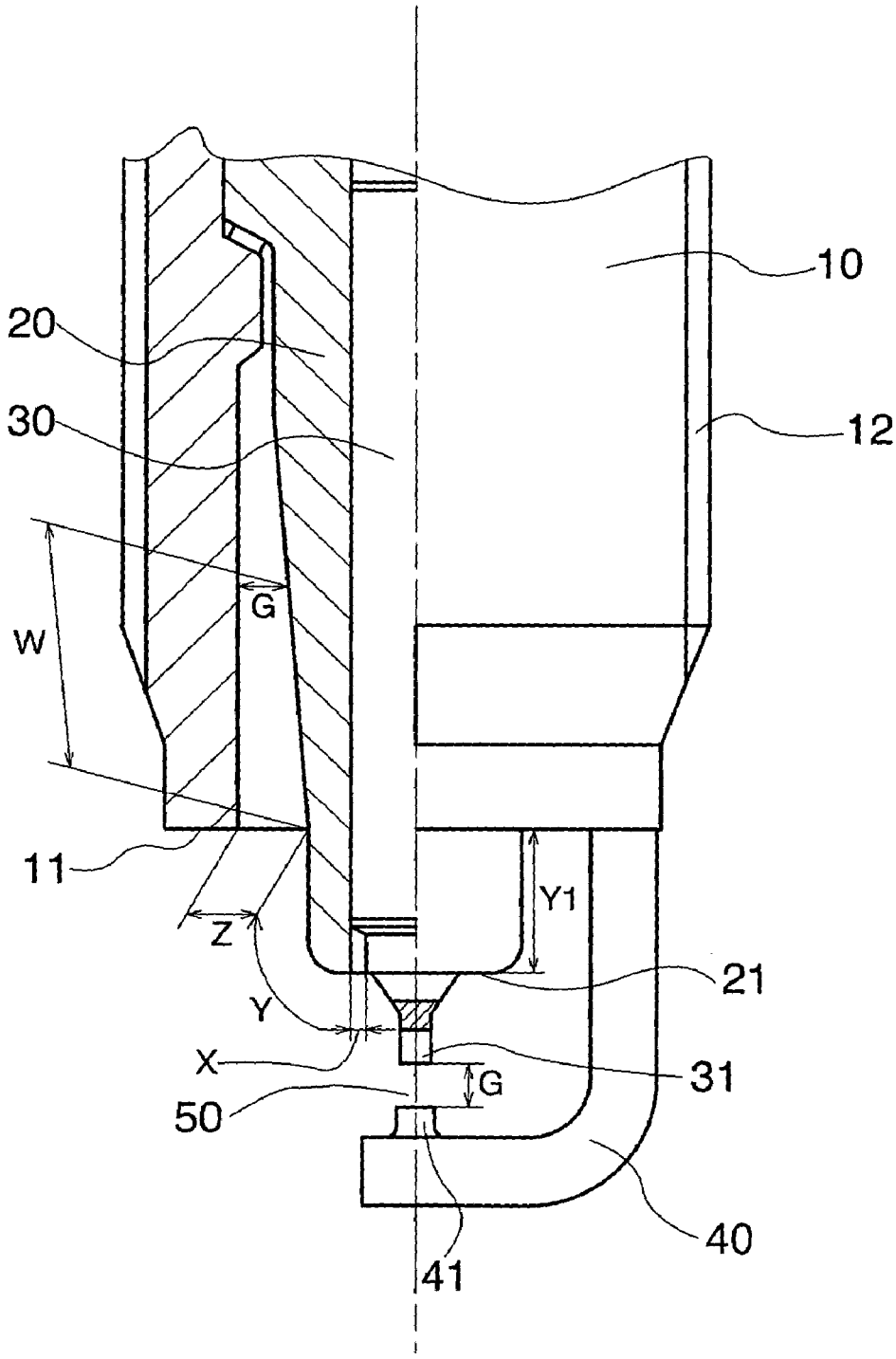
FIG. 11 is a partially cross-sectional side view showing a spark gap and the proximity thereof in a typical spark plug.

Secondly, the dimensional range of the spark gap size G in the spark plug S2 has been investigated based on the test results shown in FIG. 9.

Sample spark plugs of types K21–K24 were tested in the investigation. The resultant occurrence rates of surface-creeping sparks in the sample spark plugs of K21–K23 are less than 5%, in FIG. 9, while that in the sample spark plug of type K24 is 15%. More specifically, when the spark gap size G is equal to less than 1.3 mm, generation of the surface-creeping sparks in the spark plug S2 can be effectively suppressed, thereby facilitating generation of normal sparks across the spark gap 50.

Furthermore, the lower limit of the spark gap size G in the spark plug S2 has been experimentally determined to have the same value of 0.4 mm as in the case of the spark plug S1, in order to secure the ignition capability of the spark plug S2.

Accordingly, the dimensional range of the spark gap size G in the spark plug S2 has been specified such that $0.4\ mm \leqq G \leqq 1.3\ mm$. As a result, a high ignition capability of the spark plug S2 can be secured while suppressing generation of the surface-creeping sparks therein, when the insulator 20 thereof is not fouled with carbon.

Thirdly, with respect to the relationships between the two parameters Y1 and W/Z and the occurrence rate of inside sparks, the same tendency and similar results has been obtained as in the case of the spark plug S1. Therefore, the dimensional relationships of $Y1 \geqq 1.0\ mm$, and $W/Z \geqq 4.0$ has been specified also for the spark plug S2.

Finally, the dimensional range of the air pocket size Z in the spark plug S2 has been investigated based on the test results shown in FIG. 10.

It can be seen from FIG. 10 that, when the air pocket gap size Z is greater than 1.9 mm, the ignition capability of the spark plug drops rapidly due to generation of inside sparks.

Moreover, although not shown in FIG. 10, when the air pocket gap size Z is smaller than 1.25 mm, the ignition capability of the spark plug also drops rapidly due to the reduced space for ignition in the spark plug.

Accordingly, the dimensional range of the air pocket size Z in the spark plug S2 has been specified such that $1.2mm \leqq Z \leqq 1.9\ mm$. As a result, the capability of the slenderized spark plug S2 to ignite the air-fuel mixture through side sparks can be secured, when the insulator 20 thereof is fouled with carbon.

To sum up, the spark plug S2 according to the present embodiment, which includes the metal shell 10 having the threaded portion 12 with an outer diameter equal to 12 mm, has a structure characterized in that the dimensional parameters including the clearance X, the surface-creeping distance Y, the protruding length Y1 of the insulator 20, the air pocket size Z, and another surface-creeping distance W satisfy the following dimensional relationships:

$$(X+0.3Y+Z)/Z \geqq 2.0;$$

$$0.4\ mm \leqq G \leqq 1.3\ mm;$$

$$Y1 \geqq 1.0\ mm;$$

$$W/Z \geqq 4.0;\ \text{and}$$

$$1.2\ mm \leqq Z \leqq 1.9\ mm.$$

The above structure ensures a high ignition capability of the slenderized spark plug S2 even when the insulator 20 thereof is fouled with carbon.

In addition, other effects which have been obtained through the further preferable manners in the previous embodiment can also be obtained in the case of the spark plug S2.

Other Embodiments

While the above particular embodiments of the invention have been shown and described, it will be understood by those who practice the invention and those skilled in the art that various modifications, changes, and improvements may be made to the invention without departing from the spirit of the disclosed concept.

For example, in the previous embodiments, the first and second noble metal chips 31 and 41 are joined to the base 5 materials of the center and ground electrodes 30 and 40, respectively, by laser welding.

However, other joining means may also be used, such as resistance welding, plasma welding, and adhesive joining.

Further, the center electrode 30 and the ground electrode 40 may not include the two noble metal chips 31 and 41 respectively.

Moreover, except the essential dimensional relationships specified in the previous embodiments, other detailed dimensional ranges and/or relationships may be suitably modified, or changed in designing the spark plugs S1 and S2.

Such modifications, changes, and improvements within the skill of the art are intended to be covered by the appended claims.

What is claimed is:

1. A spark plug comprising:

a hollow metal shell having a first end and a second end opposed to the first end, said metal shell also having a threaded portion on an outer periphery thereof and an inner chamber opening at the first end, the threaded portion having an outer diameter equal to or less than 10 mm;

an insulator having a length with a first end and a second end opposed to the first end of said insulator, said insulator also having a bore formed therein, said insulator being fixed in the inner chamber of said metal shell such that the first end of said insulator protrudes from the first end of said metal shell;

a center electrode secured in the bore of said insulator, said center electrode having an end protruding from the first end of said insulator; and a ground electrode having a side surface, said ground electrode being joined to the first end of said metal shell such that the side surface of said ground electrode is opposed to the end of said center electrode through a spark gap, wherein a distance between an inner surface of said metal shell defining the inner chamber and an outer surface of said insulator has a maximum value on a first reference plane defined to extend perpendicular to the length of said insulator through an inner edge of the first end of said metal shell, and a minimum value on a reference plane defined to extend parallel to and spaced a given distance from the first reference plane, and wherein the following dimensional relationships are defined:

$$(X+0.3Y+Z)/G \geqq 2.0;$$

$$Y1 \geqq 1.0 \text{ mm};$$

$$W/Z \geqq 4.0; \text{ and}$$

$$1.25 \text{ mm} \leqq Z \leqq 1.55 \text{ mm, where}$$

X is a distance between an inner surface of said insulator defining the bore and an outer surface of said center electrode on a second reference plane defined to extend parallel to the first reference plane through an inner edge of the first end of said insulator, Y is a minimum distance from the inner edge of the first end of said insulator to the first reference plane along the first end and the outer surface of said insulator, Y1 is a distance from the first end of said insulator to the first end of said metal shell in the direction of the length of said insulator, Z is a distance between the inner surface of said metal shell and the outer surface of said insulator on the first reference plane, G is a space of the spark gap between the end of said center electrode and the side surface of said ground electrode, and W is a minimum distance on the outer surface of said insulator between the first reference plane and a third reference plane on which a distance between the inner surface of said metal shell and the outer surface of said insulator has the same value as the space G of the spark gap, the third reference plane being parallel to the first reference plane.

2. The spark plug as set forth in claim 1, wherein the space G of the spark gap between the end of said center electrode and the side surface of said ground electrode is in a range of 0.4 to 0.8 mm, inclusive.

3. The spark plug as set forth in claim 1, wherein a dimensional relationship is defined as follows:

$$(X+0.3Y+Z)/G \geqq 2.5.$$

4. The spark plug as set forth in claim 1, wherein an inner diameter D of said metal shell at the inner edge of the first end of said metal shell, and an outer diameter M of the threaded portion of said metal shell are subject to:

$$(M-D) \geqq 3.0 \text{ mm}.$$

5. The spark plug as set forth in claim 1, wherein said center electrode comprises a noble metal chip, an end of which represents the end of the center electrode, and wherein the noble metal chip of said center electrode has a cross-sectional area at the end thereof in a range of 0.07 to 0.40 $mm^2$.

6. The spark plug as set forth in claim 5, wherein the noble metal chip of said center electrode is made of an Ir-based alloy including Ir in an amount of greater than 50 weight percent and at least one additive, the Ir-based alloy having a melting point of greater than 2000 degrees Celsius.

7. The spark plug as set forth in claim 6, wherein the at least one additive is selected from Pt, Rh, Ni, W, Pd, Ru, Re, Al, $Al_2O_3$, Y, $Y_2O_3$.

8. The spark plug as set forth in claim 1, wherein said ground electrode comprises a noble metal chip having a first end joined to the side surface of said ground electrode and a second end opposed to the end of the center electrode through the spark gap, and wherein the noble metal chip of said ground electrode has a cross-sectional area at the second end thereof in a range of 0.12 to 0.80 $mm^2$, and a distance between the second end of the noble metal chip of said ground electrode and the side surface of said ground electrode is in a range of 0.3 to 1.5 mm.

9. The spark plug as set forth in claim 8, wherein the noble metal chip of said ground electrode is made of a Pt-based alloy including Pt in an amount of greater than 50 weight percent and at least one additive, the Pt-based alloy having a melting point of greater than 1500 degrees Celsius.

10. The spark plug as set forth in claim 9, wherein the at least one additive is selected from Ir, Rh, Ni, W, Pd, Ru, Re.

11. The spark plug as set forth in claim 1, wherein an outer edge of the first end of said insulator is rounded with a radius equal to or greater than 0.2 mm.

12. A spark plug comprising:

a hollow metal shell having a first end and a second end opposed to the first end, said metal shell also having a threaded portion on an outer periphery thereof and an inner chamber opening at the first end, the threaded portion having an outer diameter equal to 12 mm;

an insulator having a length with a first end and a second end opposed to the first end of said insulator, said insulator also having a bore formed therein, said insulator being fixed in the inner chamber of said metal shell such that the first end of said insulator protrudes from the first end of said metal shell;

a center electrode secured in the bore of said insulator, said center electrode having an end protruding from the first end of said insulator; and a ground electrode having a side surface, said ground electrode being joined to the first end of said metal shell such that the side surface of said ground electrode is opposed to the end of said center electrode through a spark gap, wherein a distance between an inner surface of said metal shell defining the inner chamber and an outer surface of said insulator has a maximum value on a first reference plane defined to extend perpendicular to the length of said insulator through an inner edge of the first end of said metal shell, and a minimum value on a reference plane defined to extend parallel to and spaced a given distance from the first reference plane, and wherein the following dimensional relationships are defined:

$$(X+0.3Y+Z)/G \geqq 2.0;$$

$$0.4\ \text{mm} \leqq G \leqq 1.3\ \text{mm};$$

$$Y1 \geqq 1.0\ \text{mm};$$

$$W/Z \geqq 4.0;\ \text{and}$$

$$1.25\ \text{mm} \leqq Z \leqq 1.9\ \text{mm, where}$$

X is a distance between an inner surface of said insulator defining the bore and an outer surface of said center electrode on a second reference plane defined to extend parallel to the first reference plane through an inner edge of the first end of said insulator, Y is a minimum distance from the inner edge of the first end of said insulator to the first reference plane along the first end and the outer surface of said insulator, Y1 is a distance from the first end of said insulator to the first end of said metal shell in the direction of the length of said insulator, Z is a distance between the inner surface of said metal shell and the outer surface of said insulator on the first reference plane, G is a space of the spark gap between the end of said center electrode and the side surface of said ground electrode, and W is a minimum distance on the outer surface of said insulator between the first reference plane and a third reference plane on which a distance between the inner surface of said metal shell and the outer surface of said insulator has the same value as the space G of the spark gap, the third reference plane being parallel to the first reference plane.

13. The spark plug as set forth in claim 12, wherein a dimensional relationship is defined as follows:

$$(X+0.3Y+Z)/G \geqq 2.5.$$

14. The spark plug as set forth in claim 12, wherein an inner diameter D of said metal shell at the inner edge of the first end of said metal shell, and an outer diameter M of the threaded portion of said metal shell are subject to:

$$(M-D) \geqq 3.0\ \text{mm}.$$

15. The spark plug as set forth in claim 12, wherein said center electrode comprises a noble metal chip, an end of which represents the end of the center electrode, and wherein the noble metal chip of said center electrode has a cross-sectional area at the end thereof in a range of 0.07 to 0.40 $mm^2$.

16. The spark plug as set forth in claim 15, wherein the noble metal chip of said center electrode is made of an Ir-based alloy including Ir in an amount of greater than 50 weight percent and at least one additive, the Ir-based alloy having a melting point of greater than 2000 degrees Celsius.

17. The spark plug as set forth in claim 16, wherein the at least one additive is selected from Pt, Rh, Ni, W, Pd, Ru, Re, Al, $Al_2O_3$, Y, $Y_2O_3$.

18. The spark plug as set forth in claim 12, wherein said ground electrode comprises a noble metal chip having a first end joined to the side surface of said ground electrode and a second end opposed to the end of the center electrode through the spark gap, and wherein the noble metal chip of said ground electrode has a cross-sectional area at the second end thereof in a range of 0.12 to 0.80 $mm^2$, and a distance between the second end of the noble metal chip of said ground electrode and the side surface of said ground electrode is in a range of 0.3 to 1.5 mm.

19. The spark plug as set forth in claim 18, wherein the noble metal chip of said ground electrode is made of a Pt-based alloy including Pt in an amount of greater than 50 weight percent and at least one additive, the Pt-based alloy having a melting point of greater than 1500 degrees Celsius.

20. The spark plug as set forth in claim 19, wherein the at least one additive is selected from Ir, Rh, Ni, W, Pd, Ru, Re.

21. The spark plug as set forth in claim 12, wherein an outer edge of the first end of said insulator is rounded with a radius equal to or greater than 0.2 mm.

* * * * *